United States Patent [19]

Dalton et al.

[11] Patent Number: 4,550,059

[45] Date of Patent: Oct. 29, 1985

[54] METHOD OF FORMING A TINTABLE ABRASION-RESISTANT COATING ON A SUBSTRATE AND ARTICLE PRODUCED THEREBY

[75] Inventors: Jeffrey L. Dalton, North Grosvenordale, Conn.; Philip M. Johnson, Southbridge, Mass.

[73] Assignee: Gentex Corporation, Carbondale, Pa.

[21] Appl. No.: 520,459

[22] Filed: Aug. 4, 1983

[51] Int. Cl.[4] ..... B05D 3/06

[52] U.S. Cl. ..... 428/409; 427/44; 427/54.1; 427/164; 428/412

[58] Field of Search ..... 427/54.1, 44, 164; 8/506, 507; 428/409, 412

[56] References Cited

U.S. PATENT DOCUMENTS

| | | | |
|---|---|---|---|
| 3,959,521 | 5/1976 | Suetsugi et al. | 427/44 |
| 4,173,490 | 11/1979 | Rotenberg et al. | 428/412 |
| 4,211,823 | 7/1980 | Suzuki et al. | 427/164 |
| 4,229,228 | 10/1980 | Rotenberg et al. | 106/287.14 |
| 4,291,097 | 9/1981 | Kamada et al. | 427/54.1 |
| 4,297,099 | 10/1981 | Simon et al. | 8/506 |
| 4,319,811 | 3/1982 | Tu et al. | 427/54.1 |
| 4,326,001 | 4/1982 | Sachs et al. | 428/161 |
| 4,355,135 | 10/1982 | January | 524/767 |

*Primary Examiner*—John H. Newsome

*Attorney, Agent, or Firm*—Shenier & O'Connor

[57] ABSTRACT

A tintable abrasion-resistant coating is formed on a substrate such as a lens or other optical article by applying a radiation-curable coating to the surface of the substrate and partially curing the applied coating by exposure to radiation so as to produce from about 20% to about 80% cross-linking in the coating. The exposure to radiation is terminated when the coating is partially cured to provide a coated article which is tintable but capable of being handled for shipping to a retail finisher or the like for tinting and then completion of the cure by exposure to radiation. Preferably, a radiation-curable coating comprising a triacrylate or tetracrylate monomer and a monomer containing an N-vinyl imido group is applied to a substrate comprising polycarbonate, polyallyldiglycolcarbonate, or acrylic polymer.

27 Claims, No Drawings

METHOD OF FORMING A TINTABLE ABRASION-RESISTANT COATING ON A SUBSTRATE AND ARTICLE PRODUCED THEREBY

FIELD OF THE INVENTION

This invention relates to a method of forming a tintable abrasion-resistant coating on a substrate and, in particular, to a method of forming a radiation-cured, tintable abrasion-resistant coating on an optical substrate such as polycarbonate, polyallyldiglycolcarbonate, or acrylic polymer.

BACKGROUND OF THE INVENTION

Numerous protective coatings for lenses are known to the art. Most of these coatings are thermally cured polymeric films whose composition establishes a matrix, which may possibly include functional moieties or have an appropriate degree of cross-linking resulting in a corresponding degree of porosity. The thermally cured coatings are principally the result of condensation polymerizations in which water or alcohols are driven off at high temperatures as the polymerization reaction goes to completion, the polysiloxanes being highly representative of this type of polymer.

If such coatings are to be rendered tintable, they must be formulated to include monomers having functional groups which remain unreacted in the polymerization and which are capable of binding subsequently introduced dye molecules. Alternatively, they must be cross-linked to only a limited extent so that the polymeric coating is of such porosity as to constitute a pass-through coating for the dyes. Examples of these types of tintable coatings are described in January U.S. Pat. No. 4,355,135, Suzuki et al. U.S. Pat. No. 4,211,823, and Rotenberg et al. U.S. Pat. Nos. 4,229,228 and 4,173,490.

Polymeric systems which are to serve as protective coatings can also be systems whose polymerization is radiation induced. Such systems generally involve chemically unsaturated functional groups such as vinyl or acrylic moieties. When such systems are exposed to ultraviolet (UV) radiation, radical chain polymerization, otherwise known as addition polymerization, occurs. The nature of radiation curing and the ease with which it can be used make it a highly desirable method for polymerizing protective coatings. Cure times are very short relative to thermal cure times, and the initiation and termination of the polymerization are both virtually instantaneous since they are determined by the time involved engaging or disengaging the radiation source. Examples of radiation-curable coatings are described in Tu et al. U.S. Pat. No. 4,319,811, Chung U.S. Pat. No. 4,348,462, and Matsuo et al. U.S. Pat. No. 3,968,309.

Radiation-polymerizable coatings are generally untintable once they have been applied to a substrate and cured by exposure to radiation. Instead, the desired tint must be added to the original coating formulation before its application to the substrate, as suggested in each of the three patents identified in the preceding paragraph. However, adding the dye to the coating composition before it is applied to the lens requires that separate coating procedures be employed for each desired color and degree of tint and, further, that the lens finisher retain a stock of lenses for each such tint combination desired.

Kamada et al. U.S. Pat. No. 4,291,097 discloses a radiation-curable abrasion-resistant coating composition which is said to be tintable after it has been cured. However, the relatively long dyeing time of one hour specified in the examples given suggests that the tinting process, while feasible, is relatively slow for the coating composition disclosed.

SUMMARY OF THE INVENTION

One of the objects of our invention is to provide a tintable abrasion-resistant coating on a substrate such as a lens or other optical article.

Another object of our invention is to provide a tintable abrasion-resistant coating which can be cured relatively rapidly without damaging the substrate.

Still another object of our invention is to provide a tintable abrasion-resistant coating which does not require a long dyeing time.

A further object of our invention is to provide a tintable abrasion-resistant coating which permits normal handling of a coated article before dyeing.

Other and further objects will be apparent from the following description.

In general, our invention contemplates a method of forming a tintable abrasion-resistant coating on a substrate such as a lens or other optical article in which a radiation-curable abrasion-resistant coating is applied to the surface of the substrate and then partially cured by exposure to radiation so as to produce from about 20% to about 80% cross-linking in the coating. The partially cured coating is then tinted, and the cure of the coating is completed by further exposure to radiation. Preferably, the substrate comprises polycarbonate, polyallyldiglycolcarbonate, or acrylic polymer. The coating preferably comprises a mixture of a triacrylate or tetracrylate monomer and a monomer containing an N-vinyl imido group—in particular, the coating sold by GAF Corporation under the trademark Gafgard 233D and described in Tu et al. U.S. Pat. No. 4,319,811.

The practicability of our method derives from the fact that the tintability of a radiation-cured coating is a function of the degree to which cross-linking has occurred in the coating. If the monomers are polyfunctional, the polymerization produces a three-dimensional network which will include, depending on the degree to which irradiation has occurred, various residual unsaturated chemical sites. Some are residual, unreacted monomeric moieties and some are sites generated by the various possible chain termination steps. These unsaturated sites serve as reactive or receptor sites for dye molecules, and their existence or their topological accessibility to dye molecules decreases as cure time increases. The relative porosity of the resulting polymeric film will therefore depend, as in the case of condensation polymers, on the length of time the system has undergone polymerization with concomitant cross-linking.

The ease of starting and stopping radiation-induced polymerization makes radiation-cured polymers eminently suitable materials for use in a process in which the degree of cross-linking is so controlled, by regulating the reaction time, that the resulting polymer has sufficiently unreacted dye receptor sites and sufficient porosity to allow dye take-up to the desired degree. Subsequent completion of the curing requires further exposure to a radiation source until the cross-linking has so far advanced that essentially no further reactive moieties remain.

An abrasion-resistant coating that has been only partially cured to preserve its tintability should nevertheless be sufficiently cured so as to be handleable. This is possible in the case of addition polymerization because polymerizations of this type result in the rapid formation of high polymer by a very small number of growing chains. Thus, after a brief cure time the reaction mixture consists essentially of only high polymer and unreacted monomer, with the very small remainder being the growing chains. Accordingly, one can determine a partially cured stage of such a system at which the high polymer that is formed imparts sufficient abrasion resistance to permit normal handling of the coated object, while at the same time the unreacted monomers and other functional moieties can bind the dye chemically or the incompletely cross-linked high-polymeric network can allow the dye to penetrate to the substrate.

It is for these reasons that, as we confirmed experimentally, a system consisting of monomers which cure by addition polymerization upon exposure to radiation yields an abrasion-resistant coating that is tintable in the partially cured state.

By contrast, in condensation polymerizations, which characterize thermally cured coatings, monomer disappears only in the reaction. Typically in such cases, when the degree of polymerization 10, less than 1% of monomer remains. Thus, early in the reaction of a condensation polymer, the system consists principally of oligomeric species with correspondingly large regions of the network having functional groups reacted or occluded. Accordingly, a partially cured condensation polymer that has been polymerized sufficiently to allow normal handling will, unless specially formulated as described above, exhibit relatively poor dye take-up either by reaction with functional groups or by penetration of the partially cured coating.

DESCRIPTION OF THE PREFERRED EMBODIMENTS

The inherent abrasion resistance that characterizes acrylic-based polymeric coatings makes these coatings highly preferable materials for use in a process in which the coating is only partially cured to maintain its tintability. Early experiments with the radiation-curable coating sold by GAF Corporation under the trademark Gafgard 233D indicated that this coating in particular had good inherent abrasion resistance. Accordingly, this coating was selected for further work in perfecting a tintable abrasion-resistant coating. It should be emphasized, however, that the principles developed above are generally applicable to radiation-curable coating which undergo addition polymerization, and that other such coating materials could be used in the process described herein.

The GAF coating sold under the trademark Gafgard 233D is fully described in Tu et al. U.S. Pat. No. 4,319,811, the disclosure of which is incorporated herein by reference. As described in that patent, the coating composition, which is substantially oligomer-free, stable and substantially only radiation-curable, comprises a mixture of radiation-polymerizable monomers consisting essentially of a triacrylate or tetracrylate monomer and a monomer containing an N-vinyl imido group. The weight ratio of acrylate monomer to vinyl monomer of the coating composition described in the patent is in the range of from about 1 to 1 to about 10 to 1, the vinyl monomer being present in a quantity sufficient to produce a composition having a viscosity substantially less than that of the triacrylate or tetracrylate monomer. Although the precise formulation of Gafgard 233D remains a trade secret of GAF Corporation, its specified viscosity and curing time suggest that it is a mixture of pentaerythritol triacrylate (PETA) and N-vinyl pyrrolidone (VP) in a weight ratio of about 80% to about 20%. The GAF coating composition also contains a suitable photoinitiator, which is necessary if ultraviolet radiation is used to effect the cure. As noted in the patent, other forms of radiation, such as an electron beam, may also be used.

The Gafgard 233D coating supplied by GAF is 100% solids and is too viscous to dip or spin coat. A series of dilutions in isopropanol (IPA) were made. At 35% Gafgard 233D, 65% isopropanol by weight, the coating formed a film thickness of 3 to 4 microns, a thickness within the desired range for optical purposes.

The Gafgard 233D coating is a UV-curable system. A 275-watt sunlamp was used as a UV source to cure the coating. A series of samples were made to determine the amount of exposure required for curing. The samples consisted of lenses that were dip-coated with undiluted GAF coating and cured for various durations at various distances from the fixed-intensity source. Table 1 indicates the degree of cure obtained for various combinations of exposure duration and distance from the sunlamp.

The degree of cure indicated in Table 1 was determined by the abrasion resistance of the coated lens. Cured coatings did not scratch using the steel wool test (4 pounds loaded on a ¼ inch dowel on a steel wool pad, passed over the lens surface three times). Semi-cured coatings had slight to moderate scratches, soft coatings had heavy scratches, and the tacky coating was still fluid. From these data a cure cycle of 5 minutes at 6 inches from the sunlamp was adopted as the standard cure.

TABLE 1

| | 1 min. | 2 min. | 5 min. | 10 min. |
|---|---|---|---|---|
| 6 in. | Soft | Semi-cured | Cured | Cured |
| 12 in. | Tacky | Soft | Semi-cured | Cured |

In the preceding tests it was observed that the abrasion resistance increased as the cross-link density increased. We reasoned then that at some partial stage of the cure the matrix might still be open enough and with sufficient receptor sites to allow dye to penetrate into and perhaps through the coating. Thus, the fully cured coating cured for 10 minutes at 6 inches from the lamp did not tint at all. Samples cured for 2 minutes at 6 inches from the lamp tinted very well in CR-39 dye manufactured by Brain Power Inc. (BPI). Samples cured for 5 minutes at 6 inches from the lamp tinted only slightly. Thus, the partial curing of the coating does allow access of dye molecules to the film matrix and is essential for tinting the Gafgard 233D coating, the fully cured coating not being tintable even after long tint times.

The coating experiments previously described used a coating formulation which was 65% IPA, 35% Gafgard 233D on a weight basis. Table 2 lists other formulations that were tested and were found to be acceptable in terms of adhesion to the substrate.

TABLE 2

| Formulation | Composition |
|---|---|
| 1 | 30% Gafgard 233D, 70% isopropanol (IPA) |
| 2 | 30% Gafgard 233D, 50% IPA, 20% n-butanol |
| 3 | 30% Gafgard 233D, 50% IPA, 20% diacetone alcohol |
| 4 | 30% Gafgard 233D, 40% IPA, 20% n-butanol, 10% methyl ethyl ketone |
| 5 | 30% Gafgard 233D, 50% IPA, 20% toluene |
| 6 | 50% Gafgard 233D, 50% methanol |
| 7 | 50% Gafgard 233D, 50% acetone |
| 8 | 50% Gafgard 233D, 50% diacetone alcohol |
| 9 | 50% Gafgard 233D, 50% p-xylene |
| 10 | 50% Gafgard 233D, 50% toluene |
| 11 | 50% Gafgard 233D, 50% ethyl cellosolve |
| 12 | 50% Gafgard 233D, 50% methyl ethyl ketone |

Further experiments with various relative concentrations of Gafgard 233D and solvent indicated that solutions containing from about 5% to about 100% Gafgard 233D and from about 95% to about 0% solvent by weight permitted satisfactory coating of the substrate. The particular concentration ratio selected will of course depend on such factors as the coating method, the viscosity of the undiluted coating composition, and the desired coating thickness.

We find it unnecessary to use surfactants either to improve the coating characteristics of the GAF coating composition or to render the partially cured coating more tintable. In fact, the use of surfactants is preferably avoided, as they may adversely affect the adhesion of the coating to the substrate.

An alternative curing apparatus was devised using a 6-inch 200-watt/inch UV source purchased from Voltarc Tubes. This fixture shortened the cure times considerably. The samples were placed approximately 10 inches from the source and the cure times were observed to be 60 seconds for partial cure, or tintable stage, and 120 seconds for full cure. Trials were then conducted with coated lenses cured for times varied at 15-second intervals up to 3 minutes and subsequently subjected to dyeing. These trials indicated that the coating had undergone cross-linking to such an extent as still to allow dyeing to occur up until a cure time of 60 seconds. This determination was corroborated by measurements of the infrared spectra of the coated lenses cured over the indicated time intervals. These measurements showed no significant changes in the absorption spectra for cure times exceeding 75 seconds. The degree of cross-linking could thus be inferred by comparing the spectra of the partially cured samples with the spectrum of the fully cured sample. Analyses of these infrared spectra indicated that at least about 20% cross-linking was required to permit normal handling of the coated article, and that more than about 80% cross-linking resulted in an article that either was untintable or required an unacceptably long dyeing time.

Tinting experiments showed that the Gafgard 233D coating tinted much faster than other tintable coatings and in some cases faster than the lens material itself. A series of lenses were treated in BPI grey, blue and pink dyes for CR-39 (a trademark for polyallyldiglycolcarbonate) substrates. Polycarbonate lenses provided with a partially cured coating of Gafgard 233D took only 15 seconds to reach 50% transmittance in 200° F. dye. By contrast, uncoated CR-39 lenses reaches only approximately 70% transmittance even after 2 minutes in 200° F. dye. Even slower to dye were polyallyldiglycolcarbonate lenses sold under the trademark Permalite that were coated with a heat-curable tintable coating supplied by Toray Industries; these lenses required 4 minutes in 200° F. dye to reach only 80% transmittance.

We found dyes intended for CR-39 substrates to be preferable for use even on polycarbonate substrates bearing partially cured coatings of Gafgard 233D. Experiments indicated that the dyes used remained in the coating rather than penetrating to the substrate. Since the dye-absorption characteristics of the partially cured GAF coatings are quite similar to those of CR-39, any color mismatch due to unequal absorption of dye components is minimized.

EXAMPLE 1

A polycarbonate lens of a pair of glasses was coated on both sides with a coating composed of 80% by weight Gafgard 233D, 10% by weight isopropanol and 10% by weight n-butanol. The coating on each side was cured for 60 seconds under a 200-watt/inch UV source at a distance of 10 inches from the source. The partially cured lens was observed to be tack-free and moderately abrasion resistant at this stage.

The partially cured lens was then tinted in grey dye sold by Brain Power Inc. (BPI) under the trademark Molecular Catalytic Dye. The tinting conditions were such that the dye was at 200° F. and the immersion time was 15 seconds. The resulting dyed lens had a transmittance of approximately 50% as determined by visual observation. The partially cured lens was then fully cured, using the same UV fixture cited previously, for an exposure time of 120 seconds.

EXAMPLE 2

A polyallyldiglycolcarbonate lens of a pair of glasses was coated on both sides with a coating composed of 80% by weight Gafgard 233D, 10% by weight isopropanol and 10% by weight n-butanol. The coating on each side was cured for 60 seconds under a 200-watt/inch UV source at a distance of 10 inches from the source. The partially cured lens was observed to be tack-free and moderately abrasion resistant at this stage.

The partially cured lens was then tinted in grey dye sold by Brain Power Inc. (BPI) under the trademark Molecular Catalytic Dye. The tinting conditions were such that the dye was at 200° F. and the immersion time was 15 seconds. The resulting dyed lens had a transmittance of approximately 50% as determined by visual observation. The partially cured lens was then fully cured, using the same UV fixture cited previously, for an exposure time of 120 seconds.

EXAMPLE 3

A lens molded from acrylic resin manufactured by Richardson Polymer was coated on both sides with a coating composed of 80% by weight Gafgard 233D, 10% by weight isopropanol and 10% by weight n-butanol. The coating on each side was cured for 60 seconds under a 200-watt/inch UV source at a distance of 10 inches from the source. The partially cured lens was observed to be tack-free and moderately abrasion resistant at this stage.

The partially cured lens was then tinted in grey dye sold by Brain Power Inc. (BPI) under the trademark Molecular Catalytic Dye. The tinting conditions were such that the dye was at 200° F. and the immersion time was 15 seconds. The resulting dyed lens had a transmittance of approximately 50% as determined by visual observation. The partially cured lens was then fully cured, using the same UV fixture cited previously, for an exposure time of 120 seconds.

It will be seen that we have accomplished the objects of our invention. We have provided a tintable abrasion-resistant coating for a substrate such as a lens or other optical article which can be cured relatively rapidly without damaging the substrate. Our coating does not require a long dyeing time, yet permits normal handling of a coated article.

Although it is contemplated that the lenses or other substrates bearing the partially cured coatings be ultimately tinted and further exposed to radiation to complete the cure, it should be emphasized that the partially cured, untinted lenses can be handled in commerce as semifinished articles. This, in fact, is one of the salient features of our invention.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A method of forming a tintable abrasion-resistant coating on an optical substrate including the steps of applying a radiation-curable optically transparent abrasion-resistant coating to the surface of said substrate, partially curing said applied coating by exposure to radiation, and terminating said exposure to radiation while said coating is in such a stage of partial cure that it remains tintable.

2. A method as in claim 1 in which said partial curing step is performed so as to produce from about 20% to about 80% cross-linking in said coating.

3. A method as in claim 1 in which said partial curing step comprises the step of exposing said coating to ultraviolet radiation.

4. A method as in claim 1 in which said substrate is selected from the group consisting of polycarbonate, polyallyldiglycolcarbonate, and acrylic polymer.

5. A method as in claim 1 in which said coating includes a triacrylate or tetracrylate monomer and a monomer containing an N-vinyl imido group.

6. A method as in claim 1 in which said coating includes a solvent selected from the group consisting of isopropanol, n-butanol, diacetone alcohol, methyl ethyl ketone, toluene, methanol, acetone, p-xylene, ethyl cellosolve, and mixtures thereof.

7. A method as in claim 1 in which said coating comprises (a) a monomer mixture consisting essentially of a triacrylate or tetracrylate monomer and a monomer containing an N-vinyl imido group and (b) a solvent selected from the group consisting of isopropanol, n-butanol, diacetone alcohol, methyl ethyl ketone, toluene, methanol, acetone, p-xylene, ethyl cellosolve, and mixtures thereof in the proportion by weight of from about 5% to about 100% of said monomer mixture to from about 95% to about 0% of said solvent.

8. An article of manufacture comprising an optical substrate and a radiation-curable, optically transparent abrasion-resistant coating thereon partially cured by exposure to radiation, said coating being in such a stage of partial cure that it remains tintable.

9. An article as in claim 8 in which said coating has been partially cured so as to produce from about 20% to about 80% cross-linking in said coating.

10. An article as in claim 8 in which said substrate is selected from the group consisting of polycarbonate, polyallyldiglycolcarbonate, and acrylic polymer.

11. An article as in claim 8 in which said coating comprises the reaction product of a triacrylate or tetracrylate monomer and a monomer containing an N-vinyl imido group.

12. A method of forming a tinted abrasion-resistant coating on a substrate including the steps of applying a radiation-curable coating to the surface of said substrate, partially curing said applied coating by exposure to radiation, and tinting said partially cured coating.

13. A method as in claim 12 including the step of completing the cure of said tinted coating by further exposure to radiation.

14. A method as in claim 12 in which said partial curing step is performed so as to produce from about 20% to about 80% cross-linking in said coating.

15. A method as in claim 12 in which said partial curing step comprises the step of exposing said coating to ultraviolet radiation.

16. A method as in claim 12 in which said substrate is selected from the group consisting of polycarbonate, polyallyldiglycolcarbonate, and acrylic polymer.

17. A method as in claim 12 in which said coating includes a triacrylate or tetracrylate monomer and a monomer containing an N-vinyl imido group.

18. A method as in claim 12 in which said coating includes a solvent selected from the group consisting of isopropanol, n-butanol, diacetone alcohol, methyl ethyl ketone, toluene, methanol, acetone, p-xylene, ethyl cellosolve, and mixtures thereof.

19. A method as in claim 12 in which said coating comprises (a) a monomer mixture consisting essentially of a triacrylate or tetracrylate monomer and a monomer containing an N-vinyl imido group and (b) a solvent selected from the group consisting of isopropanol, n-butanol, diacetone alcohol, methyl ethyl ketone, toluene, methanol, acetone, p-xylene, ethyl cellosolve and mixtures thereof in the proportion by weight of from about 5% to about 100% of said monomer mixture to from about 95% to about 0% by weight of said solvent.

20. An article produced in accordance with the method of claim 12.

21. A method of producing a handleable and tintable abrasion-resistant optical article including the steps of coating an optical body with an optically transparent material adapted to form an abrasion-resistant coating and exposing said coated body to material-curing radiation for a period of time which is sufficiently short to maintain said material in a tintable state but which is sufficiently long to render said material non-tacky.

22. A method of producing a tinted optical article including the steps of providing an optical substrate having a radiation-curable abrasion-resistant coating thereon partially cured by exposure to radiation and tinting said partially cured coating.

23. A method as in claim 22 in which said coating has been partially cured so as to produce from about 20% to about 80% cross-linking in said coating.

24. A method as in claim 22 in which said substrate is selected from the group consisting of polycarbonate, polyallyldiglycolcarbonate, and acrylic polymer.

25. A method as in claim 22 in which said coating comprises the reaction product of a triacrylate or tetracrylate monomer and a monomer containing an N-vinyl imido group.

26. A method as in claim 22 including the step of completing the cure of said tinted coating by further exposure to radiation.

27. A method as in claim 12 in which said substrate is an optical substrate and said coating is optically transparent.

* * * * *

UNITED STATES PATENT AND TRADEMARK OFFICE

CERTIFICATE OF CORRECTION

PATENT NO. : 4,550,059

DATED : October 29, 1985

INVENTOR(S) : JEFFREY L. DALTON and PHILIP M. JOHNSON

It is certified that error appears in the above-identified patent and that said Letters Patent are hereby corrected as shown below:

Column 3, line 25, change "only" to --early--.

Column 3, line 26, insert --is-- before "10".

Signed and Sealed this

Twenty-third Day of February, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : B1 4,550,059

DATED : January 29, 1991

INVENTOR(S) : Dalton et al

It is certified that error appears in the above-identified patent and that said Letters Patent is hereby corrected as shown below:

Column 1, line 41 (Claim 5, line 9) "tetracylate"
should be --tetracrylate--

Column 1, lines 30 to 32 (Claim 4, lines 1 to 3)
"in which said substrate...and acrylic polymer"
should not be italicized Column 1, lines 48 and 49 (Claim 7, lines 1 and 2)
"in which said coating comprises"
should not be italicized Column 2, line 47 (Claim 21, line 3) "otpical"
should be --optical--

Signed and Sealed this

Twenty-seventh Day of October, 1992

*Attest:*

DOUGLAS B. COMER

*Attesting Officer*

*Acting Commissioner of Patents and Trademarks*